United States Patent [19]

Buchegger

[11] Patent Number: 5,054,746

[45] Date of Patent: Oct. 8, 1991

[54] APPARATUS FOR HARDENING RAILS

[75] Inventor: Rudolf Buchegger, St. Florian, Austria

[73] Assignee: Voest-Alpine Industrieanlagenbau Gesellschaft m.b.H., St. Florian, Austria

[21] Appl. No.: 649,760

[22] Filed: Feb. 1, 1991

[30] Foreign Application Priority Data

Feb. 5, 1990 [DE] Fed. Rep. of Germany ..... 4003363

[51] Int. Cl.[5] ..... C21D 9/08

[52] U.S. Cl. ..... 266/114; 148/128; 148/143; 148/146; 148/155

[58] Field of Search ..... 266/114; 148/128, 143, 148/146, 155

[56] References Cited

U.S. PATENT DOCUMENTS

| | | | |
|---|---|---|---|
| 2,634,121 | 4/1953 | Peters et al. | 266/4 |
| 4,604,149 | 8/1986 | Olivotto | 266/114 |
| 4,611,789 | 9/1986 | Ackert et al. | 266/114 |
| 4,900,376 | 2/1990 | Hagen et al. | 148/146 |

FOREIGN PATENT DOCUMENTS 375402 3/1982 Austria .

*Primary Examiner*—Uprendra Roy

*Attorney, Agent, or Firm*—Collard, Roe & Galgano

[57] ABSTRACT

An apparatus for hardening rails having a rail foot, a rail head, which is to be hardened, and a web between the rail foot and the rail head comprises a dip basin for receiving the rail head, a manipulator for receiving from a feeder individual consecutive rails supported at their head and foot and for dipping the head of each rail into the dip basin, and a delivery conveyor for carrying the treated rails away from the dip basin. In order to provide such an apparatus in which the manipulator which has a simple design and which permits a monitoring of the rails as they are handled, the manipulator comprises carrying arms, which are disposed on opposite longitudinal sides of the dip basin and are displaceable in height and pivoted on an axis which extends in the longitudinal direction of the dip basin and said carrying arms have supporting brackets, which are so arranged that when the rail is in position for being hardened with the rail head at the bottom of the rail the supporting brackets protrude from the carrying arms toward the web of the rail and engage the rail foot from below.

8 Claims, 2 Drawing Sheets

APPARATUS FOR HARDENING RAILS

BACKGROUND OF THE INVENTION

1. Field of the Invention

This invention relates to an apparatus for hardening rails having a rail foot, a rail head, which is to be hardened, and a web between the rail foot and the rail head, which apparatus comprises a dip basin for receiving the rail head, a manipulator for receiving from a feeder individual consecutive rails supported at their head and foot and for dipping the head of each rail into the dip basin, and a delivery conveyor for carrying the treated rails away from the dip basin.

2. Description of the Prior Art

For a hardening of rails, in most cases from an as-rolled temperature, at least the head of the rail is quenched by a coolant. In that case it is preferred to dip the rail head into the coolant because this will result in more uniform quenching conditions over the length of the rail than a spraying of the coolant on the rail (Austrian Patent Specification 375,402). But in a series production the rail head to be dipped into a dip basin must be handled by a suitable manipulator, which receives each rail from the feeder and dips the rail head at the bottom of each rail into the dip basin so that the rail head will be quenched.

SUMMARY OF THE INVENTION

It is an object of the invention to provide for an apparatus which is of the kind described first hereinbefore a manipulator which has a simple design and which permits a monitoring of the rails as they are handled.

The object set forth is accomplished in accordance with the invention in that the manipulator comprises carrying arms, which are disposed on opposite sides of the dip basin and are displaceable in height and pivoted on an axis which extends in the longitudinal direction of the dip basin and said carrying arms have supporting brackets, which are so arranged that when the rail is in position for being hardened with the rail head at the bottom of the rail the supporting brackets protrude from the carrying arms toward the web of the rail and engage the rail foot from below.

Because carrying arms are provided on opposite longitudinal sides of the dip basin, each rail which is held between said carrying arms with the rail head facing down can be dipped into the dip basin in a simple manner and within a small space in that the carrying arms are lowered. Because the carrying arms are pivoted on an axis extending in the longitudinal direction of the dip basin, each rail, which is supported at its head and foot, can be taken over in a proper orientation from the feeder because the carrying arms can be extended to different levels and can properly be swung in so that the supporting brackets of the carrying arms can engage the inclined rail foot on both sides from below and the carrying arms on both sides of the dip basin can subsequently be moved to the same level so that the rail is rotated to the rotational position in which it is to be dipped into the dip basin. The supporting brackets may be arranged at the top ends of the carrying arms so that the carrying arms extend at least substantially below the feeding plane of the feeder. In that case the rail will be accessible from above as it is handled so that the monitoring of the rail will greatly be simplified. After the heat treatment the rail is raised by the carrying arms out of the dip basin and into the plane of conveyance of the conveyor and is then delivered to the conveyor and the carrying arms are pivotally moved toward each other in order to release the rail head.

The carrying arms must be pivoted so that they can grip each rail like tongs and that pivotal movement might be utilized for taking over the rails from the feeder, which adjoins the manipulator on one side of the latter, and for delivering each rail to the delivery conveyor for carrying each rail away from the dip basin. But a simpler design, which ensures that the rails supported at their head and foot will reliably be taken over, will be obtained if the feeder and the delivery conveyor consist each of a transverse conveyor for moving a rail support on a path which crosses the paths along which the carrying arms are extensible and retractable so that rail support is adapted to be retracted out of the range of movement of the carrying arms. In that case it is ensured that the carrying arms and each transverse conveyor, which is movable to a position over the carrying arms, will assume a relative position which permits a convenient reception and delivery of each rail by and from the carrying arms, provided that the rail support of each transverse conveyor can be retracted from the range of movement of the carrying arms so that the rail can then be lowered or raised relative to the plane of conveyance of the transverse conveyor.

An alignment of each rail to be treated with the longitudinal direction of the dip basin may not always be ensured. For this reason the feeder may comprise a rail-carrying yoke, which constitutes a rail stop extending in the longitudinal direction of the dip basin. In that case each rail will be aligned as it is transversely conveyed because each rail will be caused to slidably engage the stop of the yoke. Another advantage which is afforded by the provision of a feeder which comprises a rail-carrying yoke resides in that the carrying arms or the supporting brackets of the carrying arms of the manipulator can extend between the prongs of the yoke so that each rail can conveniently be received. The yoke for carrying each rail may be pivoted on an axis which extends in the longitudinal direction of the dip basin so that each arriving rail can be taken over by the yoke and when the rail has been transversely conveyed it can be deposited, e.g., on an intermediate support and the yoke can then be retracted before the rail is received by the manipulator and, as a result, the cycle time of the apparatus may be shortened. Because that intermediate support must also be retracted from the range of movement of the carrying arms it will be recommendable in such case to use the delivery conveyor as an intermediate support because the delivery conveyor must anyway be retractable from the range of movement of the carrying arms and otherwise is not required during the transfer of each rail from the feeder to the manipulator.

Each rail which has been quenched in the dip basin is generally delivered to a cooling bed. A very simple design may be adopted for the means for delivering each quenched rail from the carrying arms of the manipulator to the cooling bed in that the delivery conveyor comprises at least one conveying lever, which carries the rail support and is pivoted on an axis that extends in the longitudinal direction of the dip basin. If the conveyor lever has a sufficiently long lever arm that lever can effect a conveyance over a relatively large length by turning through a relatively small angle. By a pivotal movement of the conveyor lever, each rail which has been taken over from the carrying arms of the manipulator can be delivered to the cooling bed or to a cooling bed conveyor, on which the rail is again supported at its head and foot.

Various actuators may be used to extend and retract the carrying arms of the manipulator. But a particularly desirable design will be obtained if each carrying arm is provided with a rack that is in mesh with a drive pinion so that the elevation of each carrying arm can be controlled in a simple manner. If the carrying arms are thus mounted to be extended and retracted, they may be pivotally mounted in that they are longitudinally movably mounted in a guide, which is pivoted on the axis of the drive pinion, which axis extends in the longitudinal direction of the dip basin. Such an arrangement will permit the adoption of a simple design for the means for driving the drive pinion. Suitable actuators may be used to pivotally move the carrying arms about the axis of the drive pinion and may consist, e.g., of eccentric drives, which can be actuated by a common actuating shaft at least for all carrying arms on each side of the basin.

DETAILED DESCRIPTION OF THE PREFERRED EMBODIMENT

Figure 1:
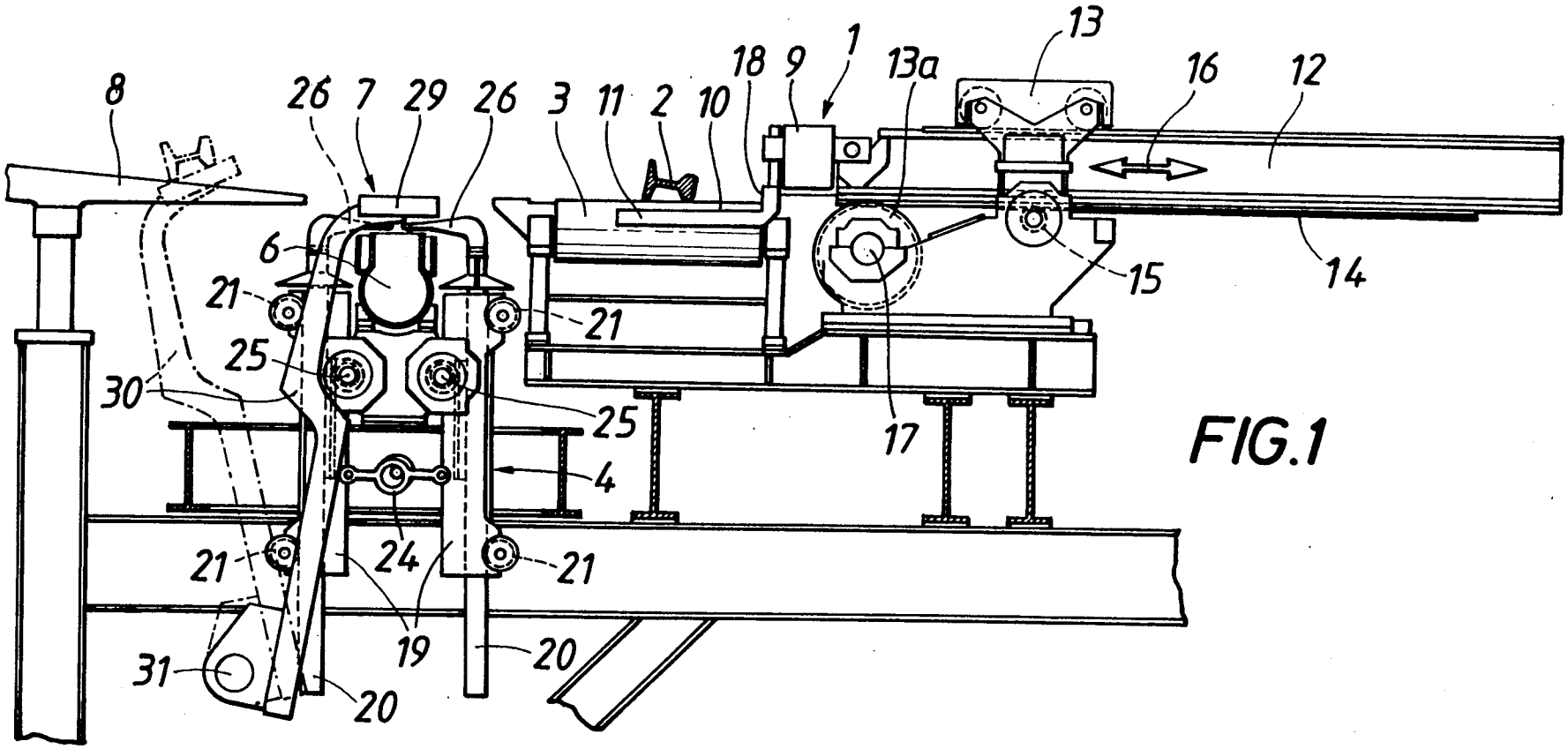
FIG. 1 is a side elevation, partly torn open, showing an apparatus in accordance with the invention for hardening rails.

An illustrative embodiment of the invention is shown by way of example in the drawing.

The illustrated apparatus essentially comprises a feeder 1 extending from a roller conveyor 3 for feeding in their longitudinal direction the rails 2 from a rolling plant, a manipulator 4 for receiving each rail 2 from the feeder 1 and for dipping the head 5 of the rail into a quenching bath in a dip basin 6, and a delivery conveyor 7 for carrying off each rail 2 which has been quenched in the dip basin 6 and for depositing each rail 2 onto a cooling bed 8. As is apparent from FIG. 1 the feeder 1 comprises a rail-carrying yoke 9, which has prongs 11, which constitute a rail support 10 and extend between the rollers of the roller conveyor 3, and the yoke 9 is operable to lift the rail 2 from the roller conveyor 3 and to feed the rail to the manipulator 4. To that end the rail-carrying yoke 9 is connected to a guide rail 12, which is held in a roller track 13 and is displaceable therein transversely to the longitudinal axis of the rail 2. The yoke 9 carries a rack 14 in mesh with a pinion 15, which is operable to move the yoke 9 in the direction indicated by the arrow 16. Because the guide rail 12 is also supported on a roller **13*a* of the roller track 13 and said roller 13*a* is movable up and down by an eccentric drive 17, the yoke 9 can also be pivotally moved about the axis of the pinion 15 to lift the rail 2 from the roller conveyor. To ensure that each rail 2 being moved to the manipulator will extend in the longitudinal direction of the dip basin 6, the yoke 9 comprises a stop 18, which extends in the longitudinal direction of the dip basin and is slidably engaged by each rail 2 as it is received by the yoke 9**.

Each rail 2 is then received by the manipulator 4, which comprises a plurality of pairs of carrying arms 20. Said pairs of carrying arms 20 are spaced along the dip basin 6 and the arms 20 of each pair are disposed on opposite longitudinal sides of the dip basin 6 and are extensible and retractable up and down in guides 19, which comprises guide rollers 21 rotatably mounted in a housing drive pinions 23 are in mesh with a rack 22 provided on each carrying arm and are operable to extend and retract the carrying arms up and down in the guides 19. The guides 19 are operatively connected to a swivel actuator 24, which preferably constitutes an eccentric drive and is operable to impart a pivotal movement to each carrying arm 20 about the drive shaft 25 for the associated drive pinion 23.

Figure 2:
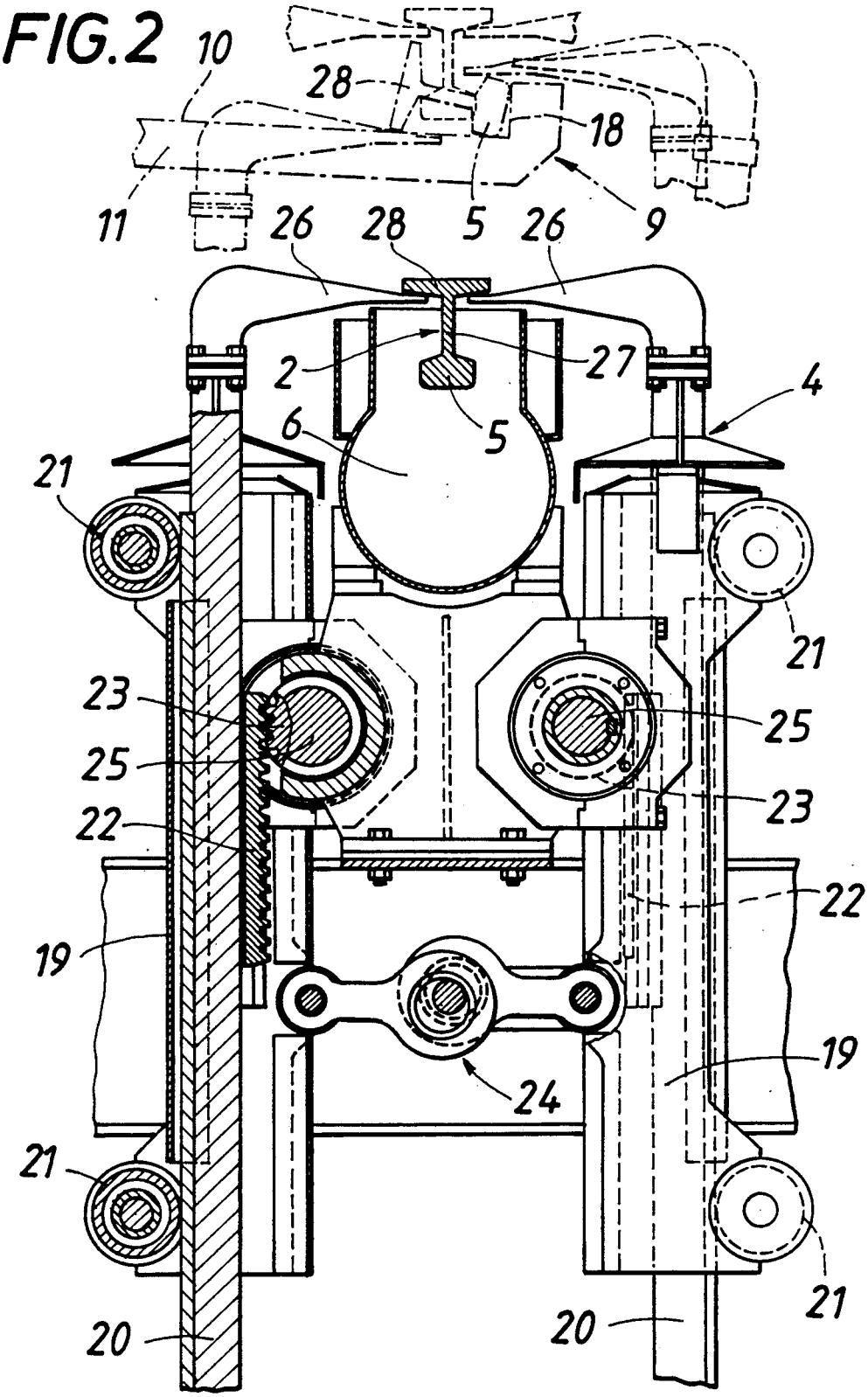
FIG. 2 is an end view, partly torn open and showing on a larger scale the manipulator of said apparatus viewed in the direction of the longitudinal axis of the dip basin.

The carrying arms 20 are shown in FIG. 2 in different operating positions by solid and dotted lines, respectively, and each carrying arm 20 is provided at its top end with a supporting bracket 26, which in said operating positions protrudes toward the web 27 of the rail 2, and the supporting brackets 26 then engage the rail foot 28 from below on opposite sides of the rail 2 when it is in position for being dipped with the rail head 5 facing down. For receiving each rail 2 from the feeder 1, the carrying arms 20 are extended by means of the rack and pinion drives 22, 23 to the positions indicated in phantom so that the rail lying on the prongs 11 of the yoke 9 at the foot and head of the rail extends between and can be supported by the carrying arms. For that purpose at least those carrying arms 20 which are associated with the rail foot portion which protrudes from the rail support 10 and are disposed on one side of the dip basin must initially be swung out so that their supporting brackets 26 can embrace and support the rail head 5, which is laterally offset from the rail foot. As is directly apparent from FIG. 2, the carrying arms 20 disposed on opposite sides of the dip basin must be extended to different levels so that the rail foot 28 can be engaged from below when it is in an inclined position. The rail 2 which is to be quenched can then be taken over by the manipulator in that the carrying arms 20 are raised further and/or the prongs arms 11 are lowered and the carrying arms 20 are caused to assume the same elevation so that the rail will be rotated to the position for being dipped; that position is indicated by dotted lines in FIG. 2. When the yoke 9 is then retracted from the range of movement of the carrying arms, the carrying arms 20 can be operated to move the rail 2 so that its head 5 is dipped into the quenching bath in the dip basin 6 and will thus be hardened.

Each rail 2 which has thus been quenched is transferred to the delivery conveyor 7, which comprises at least one conveying lever 30, which is provided with a rail support 29 extending between the carrying arms 20. The conveying lever 30 is pivotally movable about an axis 31, which extends in the longitudinally direction of the dip basin 6, and the conveying lever 30 is thus movable from a receiving position shown in solid lines in FIG. 1 to a delivering position, which is indicated in phantom and in which each rail 2 can be deposited onto the cooling bed 8. The cooling bed 8 may be provided with an intermittently operable conveyor for an intermittent advance of each rail. The operation in which each quenched rail 2 is transferred to the conveying lever 30 constitutes a reversal of the operation in which each rail is received by the manipulator 4. The carrying arms 20 are first extended to raise the rail and the conveying lever 30 is then pivotally moved to move its rail support under the rail 2. When the carrying arms are then lowered and spread apart the rail 2 will be deposited on the rail support 29 of the conveying lever 30 and will be supported thereon at the head and foot of the rail. The succeeding conveying step of the conveying lever 30 will by no means be obstructed by the carrying arms 20 of the manipulator 4 when they have been retracted to their initial position shown in FIG. 1.

To permit a retracting of the feeder 1 to its initial position for receiving the next following rail 2 advanced by the roller conveyor 3 before the preceding rail has been received by the manipulator 4, each rail to be received by the manipulator 4 may initially be taken from the feeder by the delivery conveyor 7 when the conveying lever 30 has been moved to the angular position indicated by dotted lines. The rail 2 which rests on the rail support 29 then be received by the carrying arms 20 of the manipulator 4 by an operation which is similar to the above-described operation for transferring each rail from the feeder 1 to the carrying arms 20.

I claim:

1. In an apparatus for hardening rails, each of which has a rail head, which is to be hardened, a rail foot, and a web connecting said foot to said head, which apparatus comprises an elongate dip basin extending in a longitudinal direction and adapted to hold a quenching bath, a feeder for feeding each rail toward said dip basin while said rail is supported on said head and foot, a manipulator for receiving each rail from said feeder and for supporting said rail and causing it to be dipped into said dip basin to quench said rail in said bath, and a delivery conveyor for delivering each rail after it has thus been quenched, the improvement residing in that said manipulator comprises a plurality of pairs of carrying arms, which are disposed on mutually opposite sides of said dip basin and pivoted each on an axis which extends in said longitudinal direction, which pairs of arms are spaced along said basin, said carrying arms comprise respective supporting brackets and are operable to move said brackets to a position in which said supporting brackets protrude toward each other over said dip basin and are adapted to support a rail extending in said longitudinal direction in a position in which said head of said rail faces down and the supporting brackets protrude toward said web and support said foot on its underside on opposite sides of said web, and said carrying arms are mounted to be extensible and retractable up and down along predetermined paths to raise and lower said rail when it is thus supported by said brackets.

2. The improvement set forth in claim 1, wherein said feeder and said delivery conveyor consist each of a transverse conveyor having a rail support and operable to move said rail support along a path which crosses said predetermined path for at least one of said carrying arms of each of said pairs, whereby said rail support is movable into and out of the range of movement of said carrying arms.

3. The improvement set forth in claim 1 wherein said feeder comprises a yoke for carrying each rail and said yoke comprises a stop extending in said longitudinal direction and adapted to slidably engage each rail on said feeder.

4. The improvement set forth in claim 1, wherein actuating means are provided for extending and retracting each of said carrying arms up and down and comprise a rack provided on said carrying arm and a drive pinion in mesh with said rack.

5. The improvement set forth in claim 2, wherein said delivery conveyor comprises at least one conveying lever, which is pivoted on an axis which extends in said longitudinal direction, and said lever carries said rail support of said delivery conveyor.

6. The improvement set forth in claim 3, wherein said yoke is pivoted on an axis extending in said longitudinal direction.

7. The improvement set forth in claim 4, wherein the axis of each of said drive pinions extends in said longitudinal direction and each of said carrying arms is mounted to be extensible and retractable up and down in a guide, which is pivoted on said axis of the associated drive pinion.

8. The improvement set forth in claim 7, wherein an eccentric drive is provided, which is operable to pivotally move said guides about said axes.

* * * * *